US009198556B2

(12) United States Patent
Allen et al.

(10) Patent No.: US 9,198,556 B2
(45) Date of Patent: Dec. 1, 2015

(54) METHOD OF DETERMINING A BLOCKED ROTATING SPRAY ARM IN A DISHWASHER

(71) Applicant: Whirlpool Corporation, Benton Harbor, MI (US)

(72) Inventors: Douglas T. Allen, Goshen, IN (US); Paul R. Johnson, Saint Joseph, MI (US); Blayne C. Smith, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 373 days.

(21) Appl. No.: 13/752,635

(22) Filed: Jan. 29, 2013

(65) Prior Publication Data

US 2014/0209120 A1 Jul. 31, 2014

(51) Int. Cl.

| | |
|---|---|
| ***A47L 15/22*** | (2006.01) |
| ***B08B 3/02*** | (2006.01) |
| ***A47L 15/42*** | (2006.01) |
| ***A47L 15/00*** | (2006.01) |

(52) U.S. Cl.
CPC ..... *A47L 15/4289* (2013.01); *A47L 15/0049* (2013.01)

(58) Field of Classification Search
CPC ..... A47L 15/4297; A47L 15/4289; A47L 15/4244; A47L 15/0049; A47L 15/22; A47L 2401/24; A47L 2401/30
See application file for complete search history.

(56) References Cited

U.S. PATENT DOCUMENTS

| | | | | |
|---|---|---|---|---|
| 5,681,401 | A | 10/1997 | Gardner et al. | |
| 7,445,013 | B2 | 11/2008 | VanderRoest et al. | |
| 7,523,758 | B2 | 4/2009 | VanderRoest et al. | |
| 7,709,781 | B2 | 5/2010 | Weisser et al. | |
| 8,025,743 | B2 | 9/2011 | Poyner et al. | |
| 8,192,551 | B2 | 6/2012 | Sundaram | |
| 2011/0174345 | A1* | 7/2011 | Carrer et al. | 134/115 R |

FOREIGN PATENT DOCUMENTS

| | | | |
|---|---|---|---|
| DE | 4010066 | A1 | 10/1991 |
| DE | 4020898 | A1 | 1/1992 |
| DE | 19732856 | A1 | 2/1999 |
| DE | 10121083 | A1 | 10/2002 |
| DE | 10204455 | A1 | 8/2003 |
| DE | 102006007325 | A1 | 8/2007 |
| DE | 102006007329 | A1 | 8/2007 |
| JP | 5031063 | A | 2/1993 |
| WO | 2011035940 | A1 | 3/2011 |

* cited by examiner

*Primary Examiner* — Michael Kornakov

(57) ABSTRACT

A method of operating a dishwasher having a tub at least partially defining a treating chamber and at least one rotating sprayer provided in the treating chamber to determine a stand-still condition of the rotating sprayer during an automatic cycle of operation that includes a rotation of the spray arm.

20 Claims, 3 Drawing Sheets

METHOD OF DETERMINING A BLOCKED ROTATING SPRAY ARM IN A DISHWASHER

BACKGROUND OF THE INVENTION

Dishwashers can include one or more sprayers for providing liquid to dishes positioned in the interior of the treating chamber according to a cycle of operation. Some sprayers are configured to rotate while they spray. While rotating, the sprayer may come into contact with a dish loaded in the dishwasher. The contact may prevent the rotation of the sprayer, which may negatively impact the cleaning performance of the dishwasher.

SUMMARY OF THE INVENTION

The invention relates to a method of operating a dishwasher having a tub at least partially defining a treating chamber and at least one rotating sprayer provided in the treating chamber, comprising spraying liquid from the rotating sprayer onto at least a portion of the tub to form a wetted portion of the tub, repeatedly sensing a capacitance value of the wetted tub portion to define a capacitance dataset of multiple capacitance values, determining a standstill condition of the rotating sprayer from the capacitance dataset, and indicating the determination of the standstill condition.

DESCRIPTION OF EMBODIMENTS OF THE INVENTION

Figure 1:
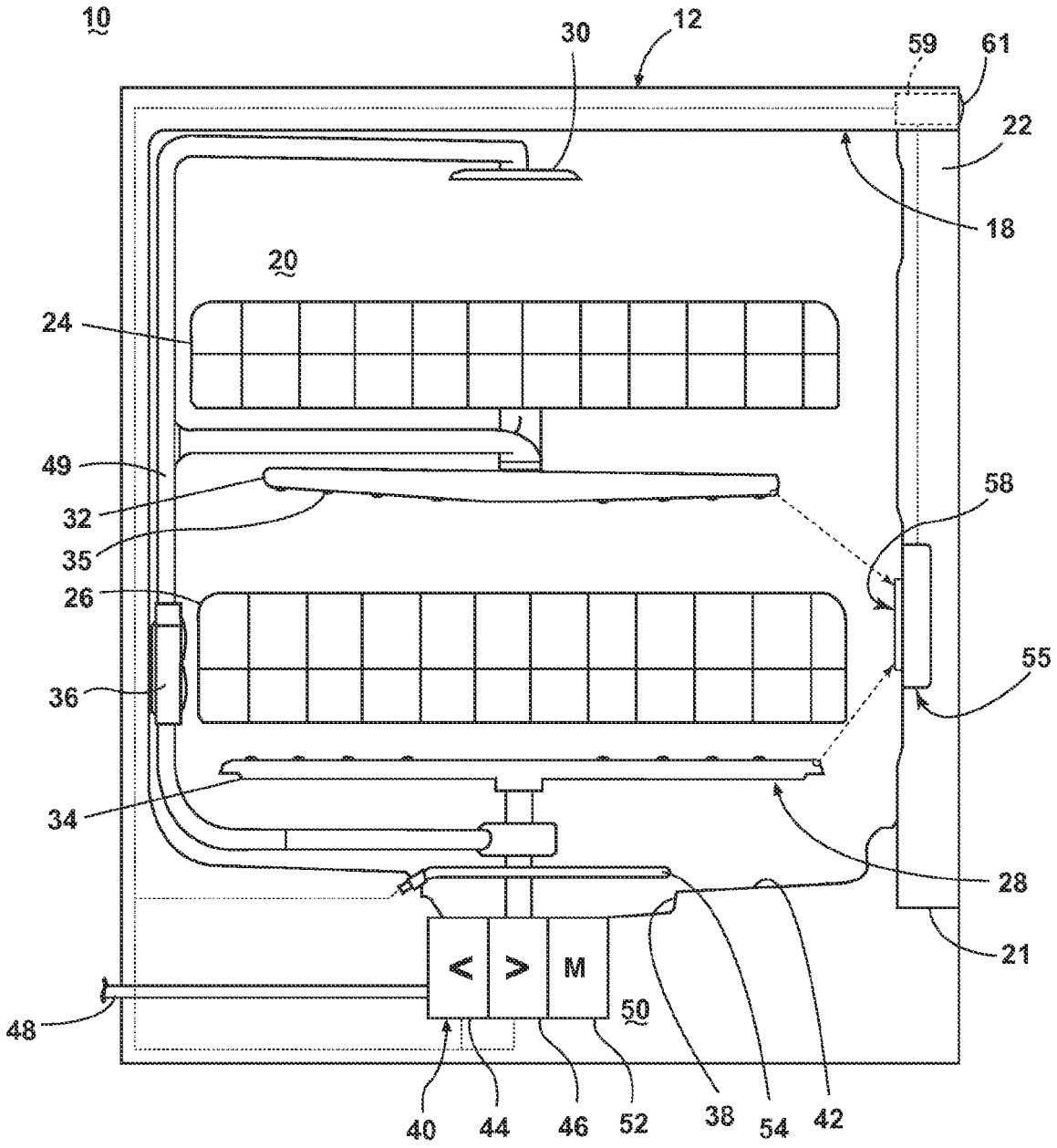
FIG. 1 is a schematic, side view of a dishwasher according to an embodiment of the invention.

FIG. 1 is a schematic, side view of a dishwasher 10 according to one embodiment of the invention. The dishwasher 10 shares many features of a conventional automated dishwasher, which will not be described in detail herein except as necessary for a complete understanding of the invention. The dishwasher 10 has a housing, which may include a cabinet or chassis 12 that may define an interior of the dishwasher 10. The dishwasher housing may also include a frame (not shown), with or without panels mounted to the frame. An open-faced tub 18 may be mounted to the dishwasher housing and provided within the cabinet 12, and may at least partially define a treating chamber 20, having an open face 21 defining an access opening, for treating dishes. A door assembly 22 may be movably mounted to the dishwasher 10 for movement between loading and treating positions to selectively open and close the open face 21 of the tub 18. Thus, the door assembly 22 provides accessibility to the treating chamber 20 for the loading and unloading of dishes or other washable items. When the door assembly 22 is closed, user access to the treating chamber 20 may be prevented, whereas user access to the treating chamber 20 may be permitted when the door assembly 22 is open. While the present invention is described in terms of a conventional dishwashing unit, it could also be implemented in other types of dishwashing units, such as in-sink dishwashers, multi tub dishwashers, or drawer-type dishwashers.

Dish holders, illustrated in the form of upper and lower racks 24, 26, respectively, are located within the treating chamber 20 and receive dishes for treating. The racks 24, 26 are typically mounted for slidable movement in and out of the treating chamber 20 for ease of loading and unloading. Other dish holders may be provided, such as a silverware basket in the tub. As used in this description, the term "dish(es)" is intended to be generic to any item, single or plural, that may be treated in the dishwasher 10, including, without limitation; dishes, plates, pots, bowls, pans, glassware, and silverware. While not shown, other dish holders may be provided, such as a silverware basket on the interior of the door assembly 22 or a third level rack above the upper rack 24 may also be provided.

A spraying system 28 may be provided for spraying liquid into the treating chamber 20 and is illustrated in the form of an upper sprayer 30, a mid-level sprayer 32, a lower sprayer 34, and a spray manifold 36. The upper sprayer 30 may be located above the upper rack 24 and is illustrated as a fixed spray nozzle that sprays liquid downwardly within the treating chamber 20. Mid-level sprayer 32 and lower sprayer 34 are located, respectively, beneath upper rack 24 and lower rack 26 and are illustrated as rotating sprayers. The mid-level sprayer 32 may provide a liquid spray upwardly through the bottom of the upper rack 24. The lower sprayer 34 may provide a liquid spray upwardly through the bottom of the lower rack 26. The mid-level sprayer 32 may optionally also provide a liquid spray downwardly onto the lower rack 26.

The upper, mid-level and lower sprayers 30, 32, 34 may include a plurality of nozzles 35, through which liquid may be sprayed in the controlled direction in the treating chamber 20.

It may be also understood that the sprayers 30, 32, 34 may be configured to rotate to spray the liquid having different liquid pressure relative to the other sprayers through a plurality of nozzles 35. For example, the lower sprayer 34 may supply higher pressure liquid spray compared to the mid-level sprayer 32, or vice versa.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18. Suitable spray manifolds are set forth in detail in U.S. Pat. No. 7,445,013, issued Nov. 4, 2008, and titled "Multiple Wash Zone Dishwasher," and U.S. Pat. No. 7,523,758, issued Apr. 28, 2009, and titled "Dishwasher Having Rotating Zone Wash Sprayer," both of which are incorporated herein by reference in their entirety.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 40 and pump the liquid out of the dishwasher 10 to a household drain line 48. The recirculation pump 46 may draw liquid from the sump 40, and the liquid may be simultaneously or selectively pumped through a supply tube 49 to each of the sprayers 30, 32, 34, 36 for selective spraying. While the pump assembly 40 is illustrated as having separate drain and recirculation pumps 44, 46, in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may be fluidly coupled with the recirculation system, and may include a water supply conduit coupled with a household water supply for supplying water to the treating chamber 20.

A motor compartment 50 may be provided beneath the sump 38 and may be separated from the treating chamber 20 by the bottom wall 42. The motor compartment 50 contains one or more heat-emitting component(s), shown herein as including the pump assembly 40 and at least one motor 52 for driving the pump assembly 40. Other heat-emitting components can also be included in the motor compartment 50, such as additional motors and controllers. As shown herein, a single motor 52 can be configured to drive both the drain pump 44 and the recirculation pump 46. Alternatively, separate motors can be provided for the drain pump 44 and the recirculation pump 46. The heat-emitting components, like the pump assembly 40 and motor 52, emit heat that warms the surrounding air to create warm air within the motor compartment 50.

A heating system including a heater 54 may be located within or near the sump 38 for heating liquid contained in the sump 38. Alternatively, the heater 54 may be located within the motor compartment 50 for heating liquid flowing into or out of the recirculation pump 46. In the latter case, the heater 54 would be considered a heat-emitting component. A filtering system (not shown) may be fluidly coupled with the recirculation flow path for filtering the recirculated liquid.

A dispensing system may be provided for storing and dispensing treating chemistry to the treating chamber 20. As shown herein, the dispensing system can include a dispenser 55 mounted on an inside surface of the door assembly 22 such that the dispenser 55 is disposed in the treating chamber 20 when the door assembly 22 is in the closed position. The dispenser 55 is configured to dispense treating chemistry to the dishes within the treating chamber 20. While not illustrated herein, the dispenser 55 can have one or more compartments (not shown) closed by a door on the inner surface of the door assembly 22. The dispenser 55 can be a single use dispenser which holds a single dose of treating chemistry, a bulk dispenser which holds a bulk supply of treating chemistry and which is adapted to dispense a dose of treating chemistry from the bulk supply during a cycle of operation, or a combination of both a single use and bulk dispenser. The dispenser 55 can further be configured to hold multiple different treating chemistries. For example, the dispenser 55 can have multiple compartments defining different chambers in which treating chemistries can be held. While shown as being disposed on the door assembly 22, the dispenser 55 may be positioned at other locations of the dispenser 54.

A capacitance sensor 58 may be provided for sensing the liquid sprayed from at least one of the sprayers 32, 34 onto the capacitance sensor 58 and provide a corresponding capacitance output, which may be used to determine if the sprayer is blocked from rotating during the treating cycle of operation.

The capacitance sensor 58 may be configured for location on the inner wall portion of tub 18 so as to sense liquid sprayed from at least one of the upper, mid-level, and lower sprayers 30, 32, 34. It is possible to locate the capacitance sensor 58 such that it can sense liquid sprayed by multiple sprayers 30, 32, 34. As illustrated, the capacitance sensor 58 is located on the detergent cup of the dispenser 55, such that when the door assembly 22 is in the closed position, the capacitance sensor 58 may face the treating chamber 20.

Alternatively, the capacitance sensor 58 may be coupled to one of the racks 24, 26 in the treating chamber 20, such that the capacitance sensor 58 may sense the spray liquid provided onto one of the racks 24, 26. In another example, the capacitance sensor 58 may be directly coupled to the inner wall of the tub 18 to receive and sense the liquid sprayed from at least one sprayer.

It may be understood that the capacitance sensor 58 may be typically oriented in the vertical direction, such that the liquid wetting the capacitance sensor may be removed from the capacitance sensor 58 by gravity, to prevent the capacitance sensor 58 from holding the liquid on the capacitance sensor 58.

The capacitance sensor 58 may include a sensing surface (not shown) for sensing the wetting by liquid. That said, when the sensing surface of the capacitance sensor 58 is wetted by liquid, the change in the capacitance may be sensed by the capacitance sensor 58 to generate peaks, which are indicative of capacitance values.

The sensed capacitance values may be dependent on the spraying condition. For example, the capacitance value may be proportional to the wetted sensing surface of the sensor 58. For example, if substantially the entire sensing surface is wetted by the liquid, maximum capacitance value may be sensed.

The capacitance value may also be effected by the amount of liquid wetting the sensing surface of the capacitance sensor 58. Assuming that the amount of liquid is proportional to the liquid pressure, high capacitance value may be observed for high pressure liquid spray, and low capacitance value may be observed for low pressure liquid spray. The liquid pressure from the sprayers may range approximately 0.5 to 2.0 psi. It is possible to configure multiple sprayers such that each sprayer has a different pressure that can be sensed and differentiated by the capacitance sensor 58 to determine the sprayer spraying the liquid.

While the sensing surface of the capacitance sensor 58 may include one sensing surface, in another embodiment, the capacitance sensor 58 may include a plurality of sensing surfaces, each of which may independently sense the wetting of the sensing surface. It is contemplated that individual capacitance sensors 58 may be provided for each of the multiple sprayers to aid in determining which of the sprayers is blocked.

Although not illustrated in FIG. 1, it may be noted that one or more sensors may be provided to the dishwasher 10 to monitor and determine the status of a cycle of operation in the treating chamber 20. For example, one or more temperature sensors may be provided to determine the temperature of air in the treating chamber 20. Other sensors such as a turbidity sensor or humidity sensor may also be included.

The controller 59 may be located within the cabinet 12 as illustrated, or it may alternatively be located elsewhere such as the door assembly 22. The controller 59 may be operably coupled with various components of the dishwasher 10 for implementing a cycle of operation. For example, the controller 59 may be coupled to the pumps, heater, dispenser and capacitance sensor to either control these components and/or receive their input for use in controlling the components.

The controller 59 may comprise a central processing unit (CPU) (not shown) and an associated memory (not shown) where various treating cycle and associated data, such as look-up tables, algorithms, may be stored. While some portion of the associated data may be stored in the memory, it is noted that not all the data may be stored in the memory. For example, the capacitance values sensed by the capacitance sensor 58 may not need to be stored in the memory. Instead, the capacitance values may be simply processed by the CPU for controlling the cycle of operation.

Non limiting examples of treatment cycles include normal, light/china, heavy/pots and pans, and rinse only. The spraying conditions for the sprayers may be determined based on the treatment cycles selected. For example, for heavy/pots and pans, the sprayer may rotate at a higher rotational speed with increased liquid spray pressure.

One or more software applications, such as an arrangement of executable commands/instructions may be stored in the memory and executed by the CPU to implement the one or more wash cycles.

A control panel or user interface 61 may be provided on the dishwasher 10 and coupled with the controller 59 for receiving user-selected inputs and communicating information to the user. The user interface 61 may include operational controls such as dials, lights, switches, and displays enabling a user to input commands, such as a cycle of operation, to the controller 59, and receive information.

During the treating cycle of operation, if somehow one or more sprayers are blocked from rotating without being noticed by the user until the end of the treating cycle, no more liquid may be sprayed to the dishes according to the treating cycle, and the user may observe a poor treating performance, which may result in the user dissatisfaction. The invention addresses this problem by providing the capacitance sensor 58 to sense the liquid provided from at least one rotating sprayer in the treating chamber 20, such that the movement of the rotating sprayer may be determined based on the capacitance values measured by the capacitance sensor 58.

Figure 2:
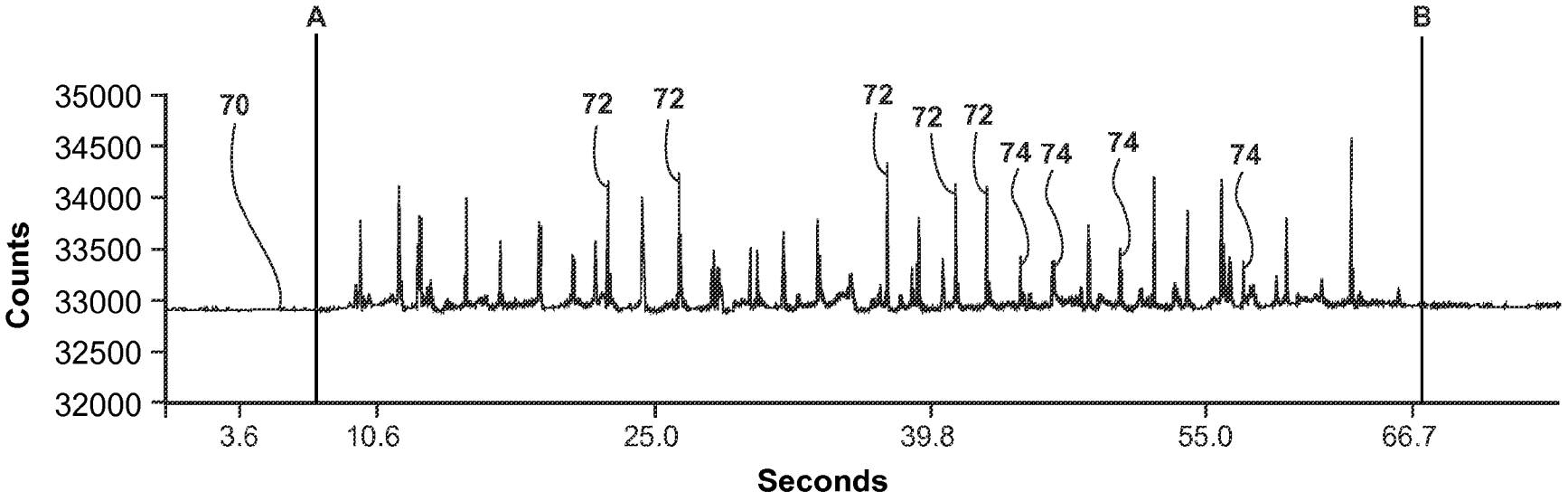
FIG. 2 is a dataset showing capacitance dataset of multiple capacitance values, measured from a capacitance sensor of the dishwasher of FIG. 1, wherein the capacitance values are indicative of the rotation of sprayers over a predetermined time period.

FIG. 2 is a capacitance dataset having multiple capacitance values, measured by the capacitance sensor 58 for a rotating sprayer of the dishwasher of FIG. 1 according to the embodiment of the invention. The capacitance values may be measured over an arbitrary or predetermined time period, starting from "A" through "B." An analysis of the dataset in the context of the rotational operation of the spray arm will provide useful insight to the invention.

During normal rotational operation of the spray arm, the spray arm rotates, at some point, such that the spray from the arm will be directed toward the capacitance sensor 58, which will result in a maximum wetting and a corresponding maximum magnitude in the output of the signal from the capacitance sensor 58. At another point in the rotation, the spray will no longer be directed toward the sensor and most of the liquid will have run off of the surface of the capacitance sensor 58, which will result in a minimum wetting of the sensor, which might or might not result in a dry sensor surface, and a corresponding minimum magnitude of the output of the signal from the capacitance sensor 58. While the minimum may vary over time, it should form a reference value, which may be used as a baseline, such as baseline 70 in FIG. 2. For purposes of this description, non-wetted and similar terms will be used to refer to when the spray from the spray arm is not directed toward the capacitance sensor 58. Thus, in a given rotation of the sprayer, the degree of wetting of the surface of the capacitance sensor 58 will vary, resulting in a corresponding variation in the capacitance value measured and/or outputted by the capacitance sensor 58. As a result, with the rotation of the sprayer, the capacitance values sensed by the capacitance sensor 58 will normally appear as multiple peaks, with the greatest magnitude peak generally corresponding to when the rotating spray arm emits liquid toward the capacitance sensor 58. The peaks can be used to determine whether or not the spray arm is rotating as expected. The magnitude of the peak and/or the frequency of the peaks can provide insight into the rotation of the spray arm.

For example, if the mid-level sprayer is expected to rotate approximately 15-25 times per minute during normal operation, it would be expected to see a peak every 2.4 to 4 seconds, or, alternatively, 15-25 peaks within one minute of data, or any corresponding sub-portion of the data. If the time between peaks is greater than 4 seconds or the number of peaks per unit time is less than expected for the unit time, but the number peaks are not zero, it is an indication that the sprayer is partially blocked; that is, the sprayer is being temporarily slowed down by contact with an object as it rotates. Alternatively, if the number of peaks is zero, then it is an indication that the sprayer is completely blocked and stuck against an object and not rotating at all.

While both the slowed rotation and the non-rotation conditions of the spray arm are not desired, the non-rotation is less desired as it will likely result in no cleaning of the dishes, whereas the slowed rotation will accomplish some cleaning. For purposes of this description, a slower than expected rotation or a non-rotation will be referred to as a standstill condition of the spray arm.

It may be noted that the peaks in FIG. 2 have a different magnitude when compared to one another. While some of the peaks 72 show high capacitance values, some of the peaks 74 show relatively low capacitance values. The variation of the capacitance magnitude among the peaks may be due to multiple parameters. First, the rotating sprayer may uncontrollably fluctuate in the vertical and/or horizontal directions while supplying liquid spray to the capacitance sensor 58. Due to the nature of difficulty in precisely controlling the path of the rotating sprayer toward the capacitance sensor 58, the stationary capacitance sensor 58 may not receive the consistent amount of liquid every time the liquid is sprayed to the capacitance sensor 58. As the amount of liquid may be proportional to the capacitance value, the variation in the amount of liquid may result in the variation in the capacitance values.

Second, the capacitance sensor 58 may not always sense the liquid at the maximum capacitance value. While the capacitance may be sensed/sampled continuously, the capacitance value may not be sensed/sampled continuously. As a result, the sensed capacitance value may be at the maximum value, wherein substantially all the surface of the capacitance sensor 58 is wetted with the liquid. Alternatively, the capacitance may be sensed when most of the surface of the capacitance sensor 58 is removed from wetting, at which the sensed capacitance may be significantly reduced compared to the maximum capacitance.

While the capacitance dataset in FIG. 2 is illustrated for showing the capacitance dataset having multiple capacitance values for one rotating spryer, the capacitance sensor 58 may also determine the standstill condition of multiple rotating sprayers.

In one example, the standstill conditions for two rotating sprayers may be determined by rotating the first and second rotating sprayers at different rotating speeds. During the cycle of operation, the first and second rotating sprayers, rotating at different rotational speeds, may spray liquid on the capacitance sensor 58. After sensing the spray liquids for unit time, the capacitance sensor 58 may provide sensed capacitance values to the controller 59, such that the controller 59 may determine if there is a standstill condition for each rotating sprayer. For example, if the frequency of the capacitance peaks for the first rotating sprayer is less than expected, or the capacitance peaks are not observed for the unit time, the first rotating sprayer may be determined to be slowed down by contact with an object as it rotates, or blocked from rotating.

In another example, different liquid spray pressures from the first and second rotating sprayers may be used in determining the standstill condition of two rotating sprayers. When the lower rack receives heavily soiled dishes, and the upper rack receives lightly soiled dishes, then the treating cycle may be configured to provide high pressure liquid spray from the first rotating sprayer to the lower rack, while the low pressure liquid spray from the second rotating sprayer may be supplied to the upper rack. During the treating cycle of operation, liquids with different pressures from the first and second rotating sprayers may be sprayed onto and sensed by the capacitance sensor 58. The capacitance sensor 58 may then generate sensed capacitance values, such that the controller 59 may differentiate first and second sprayers to determine if there is a standstill condition for at least one of the first and second rotating sprayers.

In a specific example of an elongated, vertically oriented capacitance sensor 58, the capacitance sensor 58 may be positioned so that portions of the capacitance sensor 58 are within the spray paths defined by the multiple sprayers. The spray paths may be vertically spaced relatively to the capacitance sensor 58 such that the time it takes the sprayed liquid to run down the elongated, vertically oriented capacitance sensor 58 may be used to determine which sprayer the liquid is from. Thus, the duration of the output signal from the capacitance sensor 58 may be used to determine the source of the sprayer. If multiple sprayers are impacting the capacitance sensor, then the magnitude of the output signal may show cumulative values from multiple sprayers, which should differentiate over time, assuming the sprayers are not identically rotating.

Figure 3:
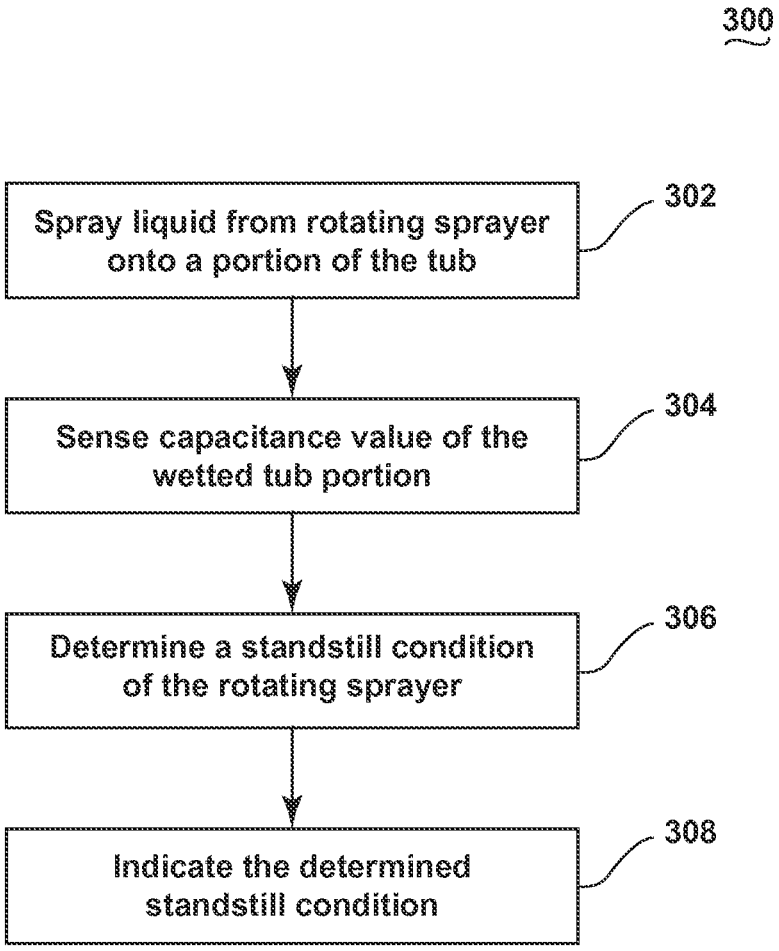
FIG. 3 is a flow chart illustrating how a standstill condition may be determined in the dishwasher of FIG. 1 according to the embodiment of the invention.

FIG. 3 is a flow chart illustrating how the standstill condition for the rotating sprayer may be determined in the dishwasher of FIG. 1, according to the embodiment of the invention. It may be understood that the sequence of steps depicted in FIG. 3 is for illustrative purposes only, and is not meant to limit the method in any way as it is understood that the steps may proceed in a different logical order, additional or intervening steps may be included, or described steps may be divided into multiple steps, without detracting from the invention. The method of FIG. 3 may be incorporated into a cycle of operation for the dishwasher 10, such as prior to or as part of any phase of a cycle of operation. For example, the wash cycle may be completed prior to the beginning of the method of FIG. 3. Alternatively, the method of FIG. 3 may also be a stand-alone cycle. For purposes of this description, the method of FIG. 3 is being implemented when the dishwasher 10 implements the operation for treating dishes according to the cycle of operation.

The method of FIG. 3 may begin at 302 by spraying liquid from at least one rotating sprayer onto a portion of the tub 18. At least one rotating sprayer may spray the liquid onto the dishes received in at least one of the upper rack 24 and lower rack 26 for treating dishes according to the cycle of operation. The rotating sprayer may also spray the liquid to wet the capacitance sensor 58 provided to the inner wall of the tub 18.

At 304, the liquid sprayed from the at least one rotating sprayer may wet the capacitance sensor 58. While the liquid wets the capacitance sensor 58 for a predetermined time period, the capacitance values, in the form of peaks, are sensed by the capacitance sensor 58 to form the capacitance dataset having multiple capacitance peaks. The magnitude of the capacitance values may be dependent on the sensing area on which liquid is wet or the duration time of the output signal from the capacitance sensor 58. The magnitude of the capacitance peaks may also be dependent on the amount of liquid or the pressure of sprayed liquid on the capacitance sensor 58.

At 306, the standstill condition of the rotating sprayer may be determined. The standstill condition may be determined by determining the magnitude of the capacitance peaks, and time between the capacitance peaks. For example, if the time between peaks is greater than expected for the unit time, the sprayer may be determined to be in contact with an object, or blocked from rotating. Similarly, if the magnitude of capacitance peak substantially reduces to the baseline level in the capacitance dataset, the sprayer may also be slowed down by contact with an object or blocked from rotating. It may be noted that the standstill condition may be determined for multiple rotating sprayers, as well as one rotating sprayer.

At 308, once the standstill condition is met, the user is notified of the standstill condition. The user may be notified by audio or visual alarm to take an appropriate step for the blocked sprayers. For example, a technical maintenance may be requested for repair.

The invention described herein provides methods for determining if one or more rotating sprayers are blocked from rotating during the treating cycle of operation. The methods of the invention can advantageously be used in notifying the user of the blockage of one or more rotating sprayers by using the capacitance sensor 58. The capacitance sensor 58 may sense the wetting of liquid sprayed from the one or more rotating sprayers, to form the capacitance dataset having multiple capacitance values. By determining the difference between the capacitance values, such as the magnitude of the peak or the time between the capacitance peaks, blocked or slowed down sprayer may be detected.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a dishwasher having a tub at least partially defining a treating chamber and at least one rotating sprayer provided in the treating chamber, the method comprising:

spraying liquid from the rotating sprayer onto at least a portion of the tub to form a wetted portion of the tub;

repeatedly sensing a capacitance value of the wetted tub portion to define a capacitance dataset of multiple capacitance values;

determining a difference of capacitance values in the capacitance dataset;

determining a standstill condition of the rotating sprayer based on the determined difference; and indicating the determination of the standstill condition.

2. The method of claim 1 wherein the spraying liquid comprises spraying the liquid onto a capacitance sensor provided in the treating chamber.

3. The method of claim 2 wherein the spraying liquid onto the capacitance sensor comprises spraying the liquid directly on the capacitance sensor.

4. The method of claim 1 wherein the repeatedly sensing the capacitance value comprises sensing capacitance values over a time period great enough for the rotating sprayer to rotate through multiple rotations.

5. The method of claim 4 wherein the repeatedly sensing the capacitance value comprises sensing capacitance values at a predetermined rate.

6. The method of claim 5 wherein the predetermined rate corresponds to at least one per rotation of the rotating sprayer.

7. The method of claim 1 wherein the at least one rotating sprayer comprises at least one of a lower sprayer, a amid-level sprayer, and an upper sprayer.

8. The method of claim 1 wherein the spraying liquid from the rotating sprayer comprises spraying liquid from first and second rotating sprayers.

9. The method of claim 8 wherein the determining the standstill condition comprises distinguishing the capacitance values from the first rotating sprayer from the capacitance values from the second rotating sprayer.

10. The method of claim 9 wherein the first and second rotating sprayers emit different liquid spray pressures and the capacitance values are distinguished based thereon.

11. The method of claim 1, further comprising determining a baseline from the repeatedly sensed capacitance values.

12. The method of claim 11 wherein the determining the difference of capacitance values in the capacitance dataset comprises comparing a capacitance value in the capacitance data set to the determined baseline.

13. The method of claim 12 wherein the standstill condition is determined when the comparing indicates the capacitance value is reduced to the determined baseline.

14. The method of claim 1, further comprising determining a magnitude of one or more peaks from the repeatedly sensed capacitance values.

15. The method of claim 10 wherein the determining the difference of capacitance values in the capacitance dataset comprises comparing the magnitude of multiple peaks.

16. The method of claim 11 wherein a standstill condition is determined when the comparing indicates a peak magnitude is reduced compared to a previous peak magnitude.

17. A method of operating a dishwasher having a tub at least partially defining a treating chamber and at least one rotating sprayer provided in the treating chamber, the method comprising:

spraying liquid from the rotating sprayer onto at least a portion of the tub to form a wetted portion of the tub;

repeatedly sensing a capacitance value of the wetted portion of the tub to define a capacitance dataset of multiple capacitance values;

determining from the capacitance dataset a set of peak values;

determining a frequency of the peak values;

determining the rotating sprayer is in a partially blocked condition or is in a standstill condition from the determined frequency of the peak values; and indicating the determination of the determined partially blocked or standstill condition.

18. The method of claim 17 wherein a partially blocked condition is determined when a time between the peak values is less than a predetermined time.

19. The method of claim 17 wherein determining a frequency of peak values comprises determining a number of peaks within a predetermined time and wherein a standstill condition is determined when the number of peaks is below a predetermined value.

20. A method of operating a dishwasher having a tub at least partially defining a treating chamber and at least one rotating sprayer provided in the treating chamber, the method comprising:

spraying liquid from first and second rotating sprayers onto at least a portion of the tub to form a wetted portion of the tub;

repeatedly sensing a capacitance value of the wetted portion of the tub to define a capacitance dataset of multiple capacitance values;

determining a standstill condition of at least one of the first and second rotating sprayers from the capacitance dataset by distinguishing the capacitance values from the first rotating sprayer from the capacitance values from the second rotating sprayer by identifying a frequency of the capacitance values when the first and second rotating sprayers are rotated at different rates; and indicating the determination of the standstill condition.

* * * * *